United States Patent [19]

Garcia

[11] 4,023,015

[45] * May 10, 1977

[54] OPERATION COUNTER FOR POWER TAKE-OFF CLUTCHES ASSOCIATED WITH WRECKER HOISTING WINCHES

[76] Inventor: Uville A. Garcia, 130 NW. 62nd Ave., Miami, Fla. 33126

[ * ] Notice: The portion of the term of this patent subsequent to Mar. 16, 1993, has been disclaimed.

[22] Filed: May 24, 1976

[21] Appl. No.: 689,531

Related U.S. Application Data

[63] Continuation-in-part of Ser. No. 551,524, Feb. 21, 1975, Pat. No. 3,951,634.

[52] U.S. Cl. ..... 235/92 PD; 235/92 B; 235/92 R

[51] Int. Cl.[2] ..... G07C 3/10

[58] Field of Search ..... 235/92 PD, 92 B, 92 TC, 235/92 PK, 98 B

[56] References Cited

UNITED STATES PATENTS

| | | | |
|---|---|---|---|
| 2,426,287 | 8/1947 | Strout | 235/92 PD |
| 3,665,165 | 5/1972 | Strandberg et al. | 235/92 PD |
| 3,944,793 | 3/1976 | Garcia | 235/92 PD |

*Primary Examiner*—Joseph M. Thesz

[57] ABSTRACT

A normally open micro-switch in the energizing circuit of an electro-mechanical counter is actuated for indicating hoisting winch operation by means of a cam fixed to the control lever of the winch take-off clutch.

2 Claims, 3 Drawing Figures

OPERATION COUNTER FOR POWER TAKE-OFF CLUTCHES ASSOCIATED WITH WRECKER HOISTING WINCHES

This application is a continuation-in-part of my application Serial No. 551,524 filed February 21, 1975 now patent No. 3,951,634 and entitled OPERATION COUNTER FOR CABLE ACTUATED MECHANICAL CLUTCHES.

The invention relates to automatic mechanical operation counters and is directed particularly to a novel and improved operation counter for lever-controlled mechanical devices such as power take-off clutches of the type associated with wrecker hoisting winches.

The power take-off mechanism associated with four-wheel drive vehicles is ordinarily controlled by a clutch lever remotely actuated by the operator through use of a flexible slide-wire cable extending between the take-off clutch at one end of the cable and a manual push-pull knob at the other end of the cable slide-wire and conveniently mounted in the cab of the vehicle for control by the operator. In the case of wrecker vehicles, the power take-off is mechanically connected with a winch or the like lifting and lowering device for the raising and lowering of a disabled vehicle to be transported. The present invention has for its principal object the provision of an operation counter for such cable-actuated mechanical clutches to enable a wrecker vehicle fleet operator keeping an accurate tally of the number of clutch operations undertaken by the operator or driver of a wrecker during the course of a business day. The wrecker fleet operator can thereby determine if unauthorized wrecker service has been rendered by any particular driver of a fleet vehicle during the course of a business day. Such unauthorized and independent wrecker use results in economic loss to the owner not only as to the charges made for such unauthorized service, but also for loss of wrecker time available for use in legitimate wrecker service.

It is a more particular object of this invention to provide an operation counter of the character described that is independently controlled by a micro-switch actuating cam adjustably fixed with respect to the power take-off clutch, thereby permitting ready installation of the recording counter at any desired location within the body or chassis of an associated vehicle, which location preferably would be substantially inaccessible to the wrecker driver to minimize any possibility of tampering therewith.

Yet another object of the invention is to provide an operation counter that is independently actuated by the control lever of a power take-off clutch lever, and includes a cam for actuating a normally-open electrical switch adapted to be close-circuited temporarily during the performance of an operation for registering on an electro-mechanical counter the number of operations being performed on the power take-off clutch by its independent manually controlled slide wire cable.

A more particular object of this invention is to provide an operation counter of the above nature wherein the micro-switch actuating cam is provided with a plurality of cam lobes, which can be sequentially brought into actuating or operative position with respect to the micro-switch before failure of the previously operated cam lobe because of excessive wear, thereby assuring dependable operation of the counter at all terms.

Yet another object of the invention is to provide an operation counter of the character described which will be simple in construction, easy to install, inexpensive to manufacture and long wearing in use.

Other objects, features and advantages of the invention will be apparent from the following description when read with reference to the accompanying drawings. In the drawings, wherein like reference numerals denote corresponding parts throughout the several views.

Figure 1:
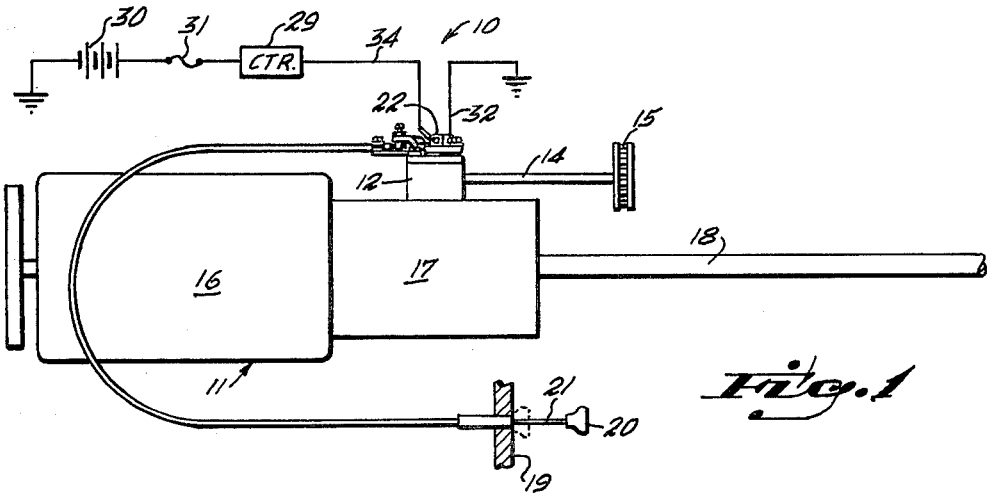
FIG. 1 illustrates, partly schematically and partly mechanically, an operation counter embodying the invention shown in association with a power take-off clutch mechanism of a wrecker vehicle for counting lifting and lowering operations of the winch mechanism.

Referring in detail to the drawings, reference numeral 10 designates, generally, an operation counter embodying the invention, the same being illustrated for use in association with a wrecker vehicle engine 11 having a power take-off gear box 12 controlled by a power take-off clutch lever 13 for setting into operation a power take-off drive shaft 14 carrying a take-off drive gear 15 powering a winch or the like mechanism (not illustrated) for lifting and lowering a disabled vehicle to be transported. FIG. 1 further illustrates, by way of example and in block form, the vehicle motor 16, main clutch and transmission gear box 17 and drive shaft 18 for powering the rear wheels of a typical wrecker to which the present invention is applied. Reference numeral 19 in FIG. 1 designates a portion of the dash-board or instrument panel of the vehicle in which the actuating knob 20 is installed for take-off clutch operation through flexible slide cable 21 in the manner hereinbelow more particularly described.

Figure 2:
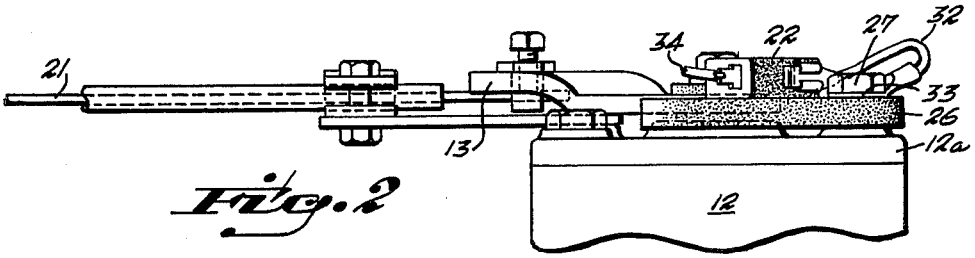
FIG. 2 is a partial view seen from above of the power take-off clutch housing and control lever, showing the details of the electrical counter switch and its support mechanism.
Figure 3:
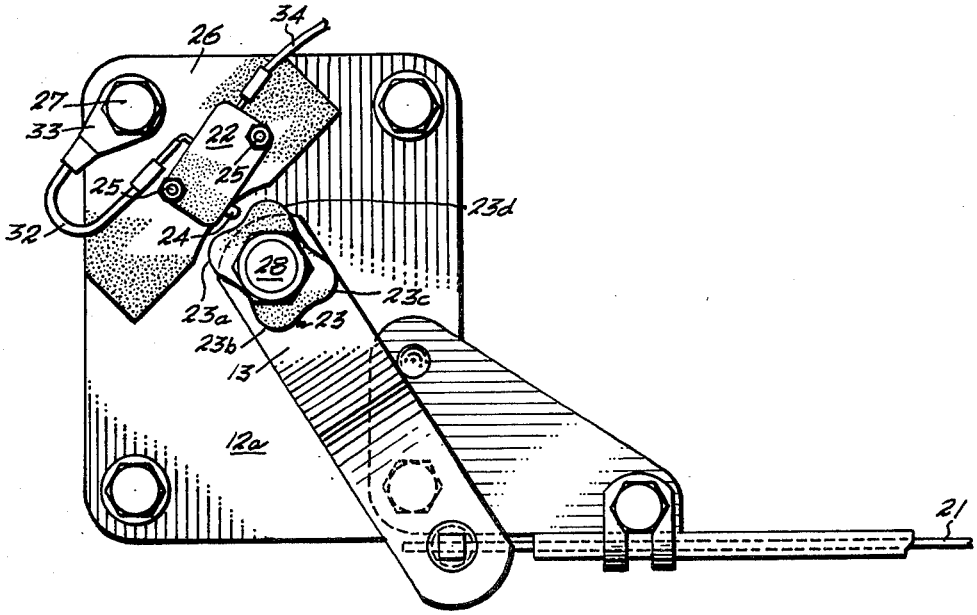
FIG. 3 is an elevational view of the outside of the power take-off mechanism housing illustrating its actuating lever, its control mechanism, and the switch and cam mechanism for energizing the counter circuit.

As best illustrated in FIGS. 2 and 3 my invention comprises the combination of a micro-switch 22 fixed with respect to the take-off gear box 12 and a cam 23 adjustably secured with respect to the pivotal axis of the power take-off clutch lever 13. The cam 23 is preferably formed with a plurality, four in the embodiment illustrated, of cam lobes 23*a*, 23*b*, 23*c*, 23*d*, any one of which, selectively, is adapted to actuate the switch button 24 of the micro-switch 22 each time the clutch lever 13 is moved back or forth during hoisting operations as is hereinafter more particularly described. As illustrated in FIG. 3, the micro-switch 22 is secured, as by machine screws 25, to a generally triangular mounting plate 26 which, in turn, is secured with respect to the gear box 12 by means of one of the machine screws 27 which serve to secure the gear box cover plate 12*a* in place. With further reference to FIG. 3, it will be seen that the micro-switch 22 is so secured with respect to the power take-off gear box 12 that its switching button 24 is properly positioned for actuation by one of the cam lobes, selectively, of the cam 23. In this connection it is to be noted that the cam 23 is provided with a central opening through which the machine bolt 28 securing the clutch lever 13 to the internal clutch mechanism of the gear take-off box 12 extends for clamping said cam in place.

It will be understood that each time the power take-off clutch actuating control knob 20 is pulled outwardly of the dashboard for an engagement of the power take-off clutch to operate the hoist mechanism or winch, the normally open micro-switch 22 will be momentarily close-circuited to complete an energization circuit to electro-mechanical counter 29 through vehicle battery 30 returned to vehicle chassis ground through series fuse 31 (see FIG. 1). As illustrated in FIGS. 1 and 3, an electrical conductor 32 interconnects one switch terminal of micro-switch 22 to chassis ground by means of an electrical connector lug 33 clamped under machine bolt 27 which serves to secure the triangular mounting plate 26 in place. The remaining terminal of the micro-switch 22 connects through conductor 34 to one energization terminal of the operation counter 29.

In use, when the operator of the winch or hoist mechanism wishes to set it into operation for lifting or lowering a disabled vehicle, for example, he will pull the actuating knob 20 outwardly a distance of about 3 or 4 inches, causing sufficient turning of the power take-off clutch lever 13 in the forward direction of the wrecker, that is, the anti-clockwise direction as illustrated in FIG. 3, to engage the power take-off transmission with consequent powering of the winch to operate in one direction or the other, depending upon whether the engine transmission 17 is set in forward or reverse gear, to raise or lower a vehicle. With reference to FIG. 3, it will be seen that as the control wire 21 is thus actuated to engage the power take-off mechanism, the cam lobe 23*a* will have abuttingly engaged and pushed inwardly, momentarily, the actuating or control button 24 of the micro-switch 22, thereby momentarily close-circuiting the above-described energization circuit to the counter 29, to record a hoisting operation. Thus, each time the micro-switch 22 is actuated upon pulling out or pushing in of the control wire actuating knob 20 as described above, the counter 29 will receive an electrical energizing impulse operative to advance its counting mechanism by one unit. Since the electro-mechanical counter 29 is interconnected in its energizing circuit by a pair of flexible electrical conductor leads, it can be mounted at any location within the wrecker cab or within the engine compartment of the wrecker vehicle. For example, it can conveniently be placed at any position whether readily observable or hidden from direct view, as desired by the owner of the vehicle.

Since a towing job will normally involve four control cable operations, that is, winch lift start by pulling outwardly upon the actuating knob 20 for raising a vehicle, raised vehicle stop by next pushing the actuating knob in again, then winch lowering by again pulling outwardly upon the actuating knob, and then winch lowering stop upon finally pushing the control knob in again, a single towing job from pick-up to release of a towed vehicle will register four counts on the electro-mechanical counter 29. If, however, it is desired to record only one unit on the counter for each towing job, that is, for completion of all of the four operational steps of a completed towing job, the counter 29 could be of such design as to record one unit for each group of four impulses received by actuation of the electrical micro-switch 22.

A salient feature of the invention resides in the fact that if the cam lobe of the micro-switch actuating cam 23 that is in use eventually becomes so worn that it is no longer reliable in its operation, the securing machine bolt 28 can easily be loosened to allow repositioning for use of the next cam lobe, for example, cam lobe 23*b*, etc., successively, until all of the cam lobes have been worn away in service. This feature assures that no replacement of parts will ordinarily be required during the useful life of the associated wrecker vehicle.

While I have illustrated and described herein only one form in which my invention can conveniently be embodied in practice, it is to be understood that this form is presented by way of example only and not in a limiting sense. The invention, in brief, comprises all the embodiments and modifications coming within the scope and spirit of the following claims.

What I claim as new and desire to be secured by Letters Patent is:

1. In a mechanical operation counter for use in association with a cable-controlled, lever-actuated power take-off clutch for controlling the operation of a mechanical device, wherein the lever is movable back and forth by a cable connected with one end of the lever, and the other end of the lever is fixed to an actuating member rotatably journalled in the power take-off clutch housing and extending outwardly of a side wall cover comprising said housing, the improvement comprising a normally open-circuit electrical switch means fixed with respect to said side wall cover and cam means fixed with respect to the pivotal end of the lever for movement in unison therewith about a common rotative axis and operative to momentarily close circuit said switch means upon movement of the lever in one direction or the other by use of the cable, said switch means being a micro-switch having a switch actuating button, and said cam means being in the form of a rotary disc having a plurality of radially-extending lobes adjustably fixed with respect to the lever for selectively placing one of said lobes in actuating position with respect to said switch actuating button.

2. A mechanical operation counter as defined in claim 1, and further comprising an electrically actuated counter and an electrical energizing circuit for said counter, said micro-switch being connected in series in said energizing circuit.

* * * * *